US007118277B2

(12) United States Patent
Chen et al.

(10) Patent No.: US 7,118,277 B2
(45) Date of Patent: Oct. 10, 2006

(54) SLIDE ASSEMBLY

(75) Inventors: Ken-Ching Chen, Kaohsiung Hsien (TW); Shih-Long Hwang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 111 days.

(21) Appl. No.: 11/006,585

(22) Filed: Dec. 8, 2004

(65) Prior Publication Data

US 2006/0120636 A1 Jun. 8, 2006

(51) Int. Cl.
*A47B 88/00* (2006.01)

(52) U.S. Cl. ..... 384/21; 312/334.46

(58) Field of Classification Search ..... 312/333, 312/334.44–334.46, 334.8, 334.11, 334.17; 384/18–21

See application file for complete search history.

(56) References Cited

U.S. PATENT DOCUMENTS 3,650,578 A * 3/1972 Del Vecchio et al. ..... 384/18
4,560,212 A 12/1985 Papp et al.
5,551,775 A 9/1996 Parvin
5,757,109 A 5/1998 Parvin
6,350,001 B1 2/2002 Chu
6,450,600 B1 * 9/2002 Chen et al. ..... 312/334.46
6,585,335 B1 7/2003 Hwang et al.
6,655,763 B1 12/2003 Judge et al.
6,705,689 B1 3/2004 Chen et al.
6,749,276 B1 6/2004 Judge et al.
6,805,418 B1 10/2004 Milligan
6,997,611 B1 * 2/2006 Chen et al. ..... 384/21
2003/0107309 A1 6/2003 Lauchner
2003/0111942 A1 6/2003 Judge et al.

* cited by examiner

*Primary Examiner*—Thomas R. Hannon
(74) *Attorney, Agent, or Firm*—Birch, Stewart, Kolasch & Birch, LLP

(57) ABSTRACT

A slide assembly includes an outer slide member, an intermediate slide member, and an inner slide member. The outer slide member includes an opening for mounting a locking member. A lug is mounted on an end of the locking member and abuts against a side of a periphery delimiting the opening. A resilient plate includes a first end fixed on the outer slide member and a second end pressing against the lug of the locking member, thereby biasing the other end of the locking member away from an inner face of the outer slide member. An unlatching member includes an end fixed on the intermediate slide member. The unlatching member further includes a substantially U-shaped actuating section extendable through a slot in the intermediate slide member. Two downwardly extending stops are formed on two lateral sides delimiting the slot by pressing.

4 Claims, 6 Drawing Sheets

SLIDE ASSEMBLY

BACKGROUND OF THE INVENTION

1. Field of the Invention

The present invention relates to a slide assembly. In particular, the present invention relates to a slide assembly comprising an outer slide member, an intermediate slide member, and an inner slide member.

2. Description of Related Art

A wide variety of three part slide assemblies have been proposed. A typical three-part slide assembly comprises an outer slide member, an intermediate slide member, and an inner slide member. Positioning devices are provided between the inner slide member and the intermediate slide member and between the intermediate slide member and the outer slide member, preventing undesired retraction of the inner slide member and the intermediate slide member. Examples of the three-part slide assemblies are disclosed in, e.g., U.S. Pat. Nos. 4,560,212; 5,551,775; 5,757,109; 6,350,001; 6,585,335; 6,655,763; 6,705,689; 6,749,276; and 6,805,418; and U.S. Patent Publication Nos. 2003/0107309 and 2003/0111942.

The present invention is intended to provide a different design in this regard.

OBJECTS OF THE INVENTION

An object of the present invention is to provide a slide assembly comprising an outer slide member, an intermediate slide member, and an inner slide member, wherein the element design, operation, and manufacturing of the slide assembly are more reasonable.

SUMMARY OF THE INVENTION

In accordance with an aspect of the present invention, a slide assembly comprises an outer slide member, an intermediate slide member slidably received in the outer slide member, and an inner slide member slidably received in the intermediate slide member. The outer slide member includes an opening for mounting a locking member. A lug is mounted on a first end of the locking member and abuts against a side of a periphery delimiting the opening. A resilient plate includes a first end fixed on the outer slide member and a second end pressing against the lug of the locking member, thereby biasing a second end of the locking member away from an inner face of the outer slide member.

The intermediate slide member includes a slot. An unlatching member is mounted on the intermediate slide member. The unlatching member includes an arcuate plate and an arm extending from a first end of the arcuate member, with a distal end of the arm being fixed on the intermediate slide member. The unlatching member further includes a substantially U-shaped actuating section extending from a second end of the arcuate plate. The actuating section is extendable through the slot of the intermediate slide member. Two downwardly extending stops are formed on two lateral sides delimiting the slot by pressing.

In an embodiment of the invention, the lug includes a hole, and the outer track includes a protrusion projecting from a side of a periphery delimiting the opening into the hole of the lug.

The outer slide member further includes two lugs formed on a side of the periphery delimiting the opening. The locking member includes a projection received in a space between the lugs.

In a modified embodiment of the invention, the resilient plate is integrally formed with and extends from the lug.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
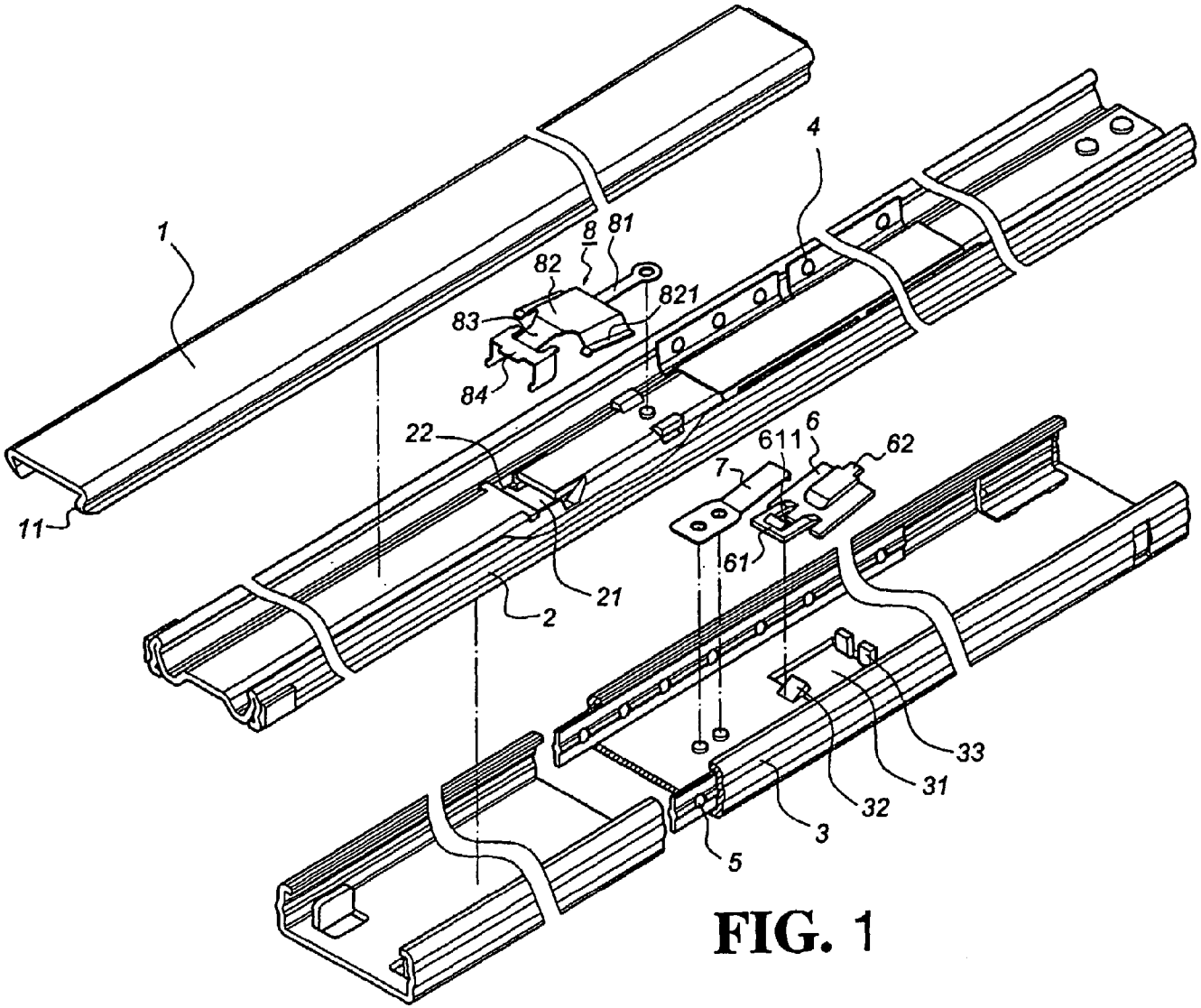
FIG. 1 is an exploded perspective view of an embodiment of a slide assembly in accordance with the present invention.
Figure 2:
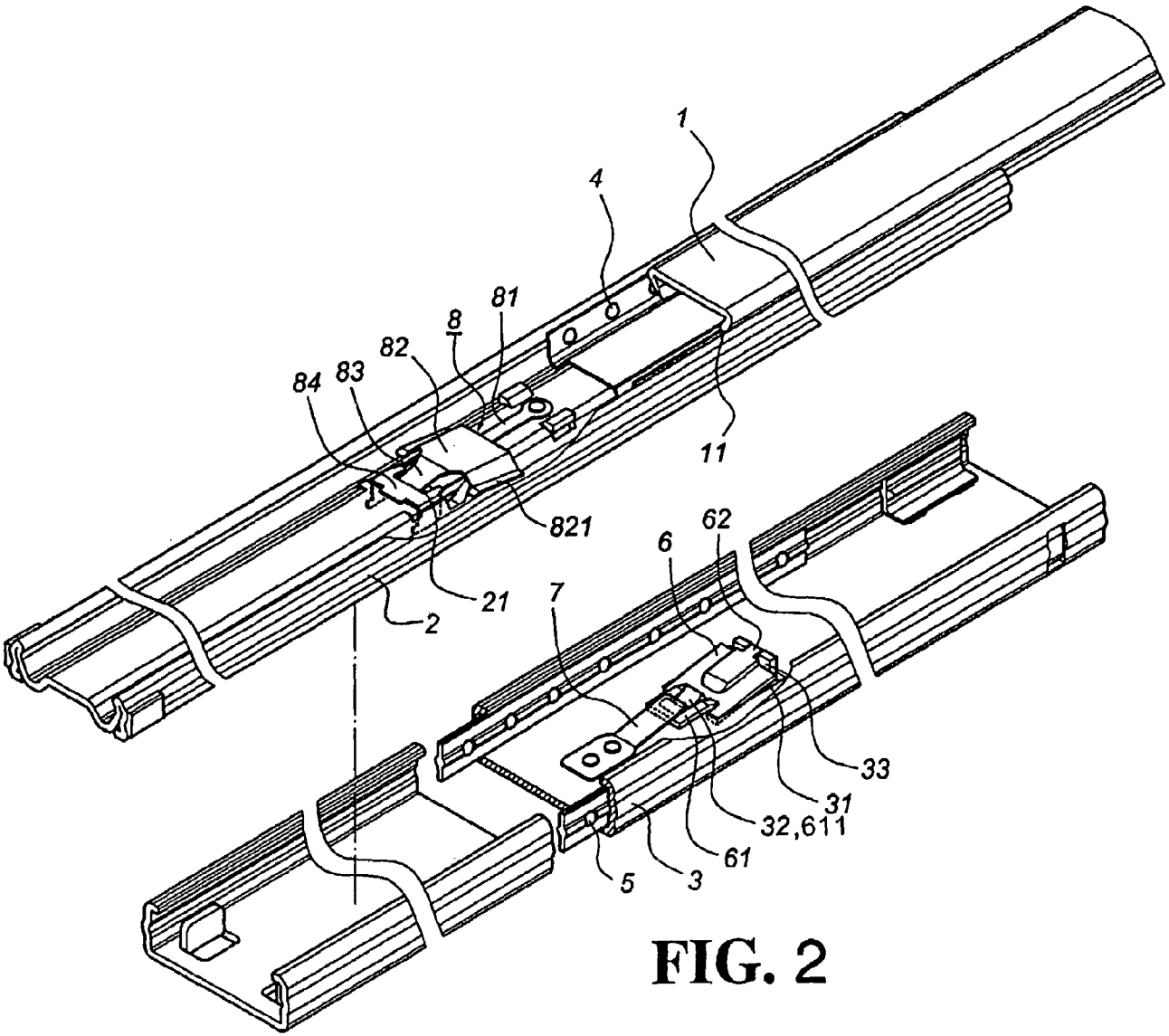
FIG. 2 is a partly exploded perspective view of the slide assembly in FIG. 1.
Figure 3:
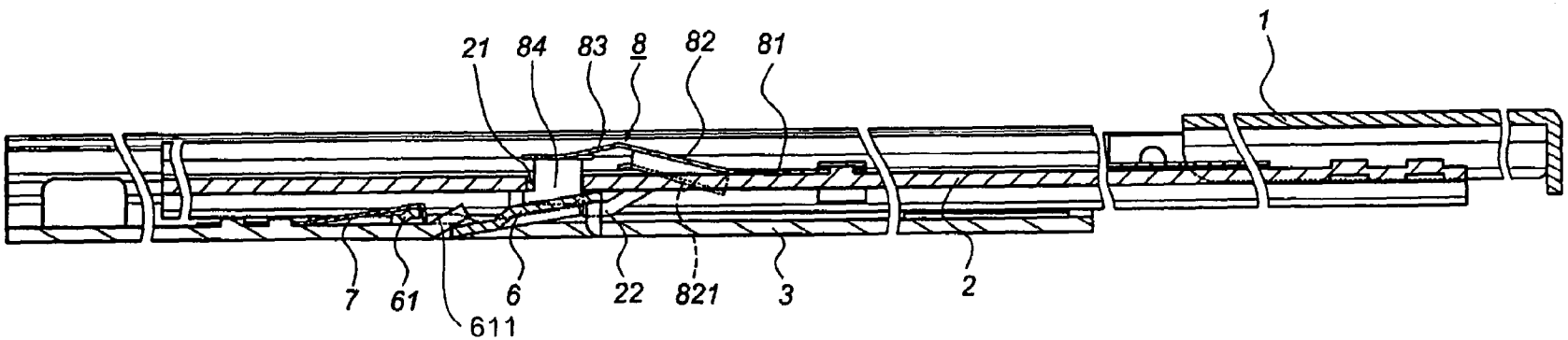
FIG. 3 is a sectional view of the slide assembly in FIG. 1, wherein the slide assembly is in an extended state.

Referring to FIGS. 1 through 3, a slide assembly in accordance with the present invention is used for a drawer or the like and comprises an outer slide member 3, an intermediate slide member 2, and an inner slide member 1. Slide-aid members 4 are provided between the inner slide member 1 and the intermediate slide member 2, allowing smooth sliding movement therebetween. Slide-aid members 5 are provided between the intermediate slide member 2 and the outer slide member 3, allowing smooth sliding movement therebetween. Further, the extended extent of the inner slide member 1 with respect to the intermediate slide member 2 and the extended extent of the intermediate slide member 2 with respect to the outer slide member 3 are limited. Such a structure is conventional and therefore not described in detail.

The outer track 3 includes an opening 31 for mounting a locking member 6. The locking member 6 includes a lug 61 on a first end thereof. In the illustrated embodiment, the lug 61 includes a hole 611, and the outer track 3 includes a protrusion 32 projecting from a side of a periphery delimiting the opening 31 into the hole 611 of the lug 61, thereby retaining the lug 61 on the protrusion 32. Two lugs 33 are formed on an opposite side of the periphery delimiting the opening 31. A space is defined between the lugs 33 for receiving and guiding a projection 62 on a second end of the locking member 6. Further, a resilient plate 7 includes a first end fixed on the outer track 3 and a second end engaged with the lug 61. The resilient plate 7 biases the second end of the locking member 6 to a location away from the inner face of the outer track 3. Thus, the locking member 6 may sway like a lever and return to the original position under the action of the resilient plate 7.

An unlatching member 8 is mounted on the intermediate slide member 2. In particular, the unlatching member 8 includes an arcuate plate 82, an arm 81 extending from an end of the arcuate plate 82 and having a distal end fixed to the intermediate slide member 2, and a substantially U-shaped actuating section 84 extending from the other end of the arcuate plate 82. In the illustrated embodiment, a bent section 83 is formed between the U-shaped actuating section 84 and the arcuate plate 82. The arcuate plate 82 includes two slanted lateral sides 821. The intermediate slide member 2 includes a slot 21 aligned with the U-shaped actuating section 84. Two stops 22 are formed on two lateral sides delimiting the slot 21 by pressing. Preferably, the stops 22 extend downward from an outer face of the intermediate slide member 2.

In a case that the inner slide member 1 and the intermediate slide member 2 are pulled outward with respect to the outer slide member 3, when the intermediate slide member 2 reaches a fully extended state with respect to the outer slide member 3, the second end of the locking member 6 is moved toward the intermediate slide member 2 to abut against the stops 22 under the action of the resilient plate 7, thereby preventing retraction of the intermediate slide member 2, as shown in FIG. 3. It is noted that the U-shaped actuating section 84 is extended through the slot 21 of the intermediate slide member 2 to abut against the second end of the locking member 6 such that the unlatching member 8 warps.

Figure 4:
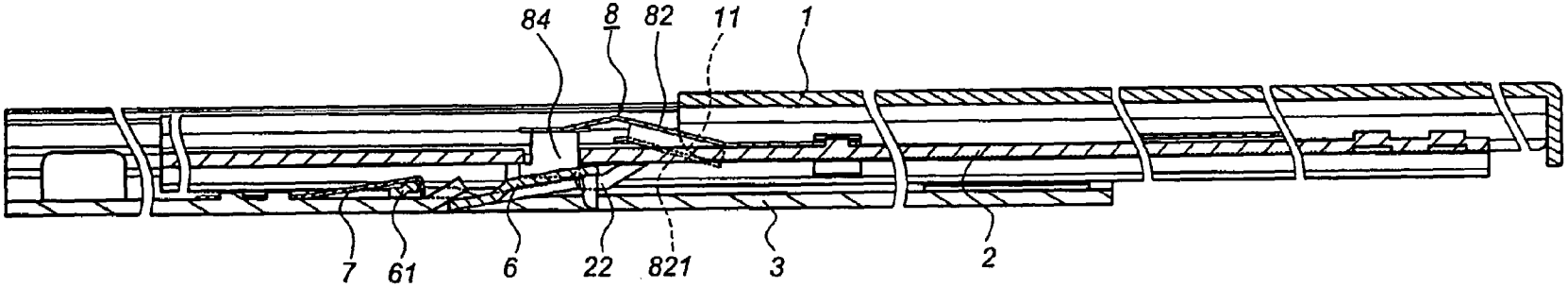
FIG. 4 is a sectional view similar to FIG. 3, wherein an inner slide member of the slide assembly is being retracted.
Figure 5:
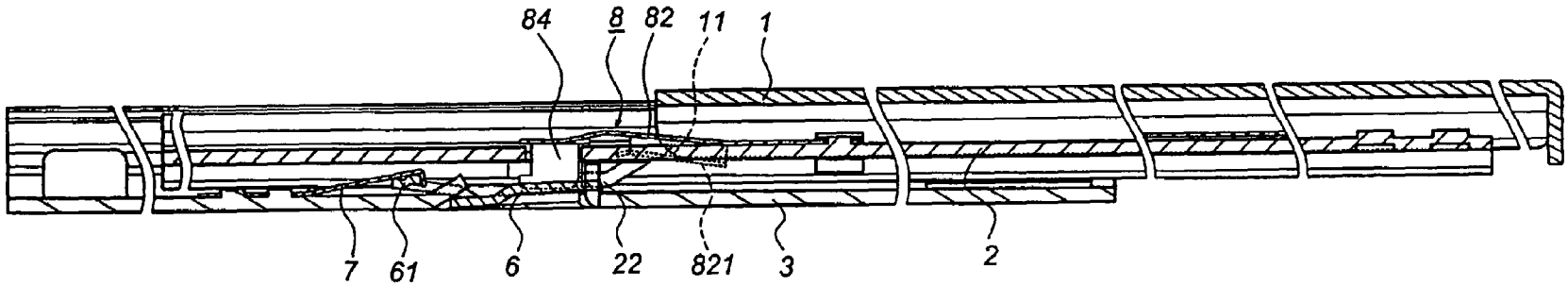
FIG. 5 is a sectional view similar to FIG. 4, wherein an unlatching member of the slide assembly is actuated.
Figure 6:
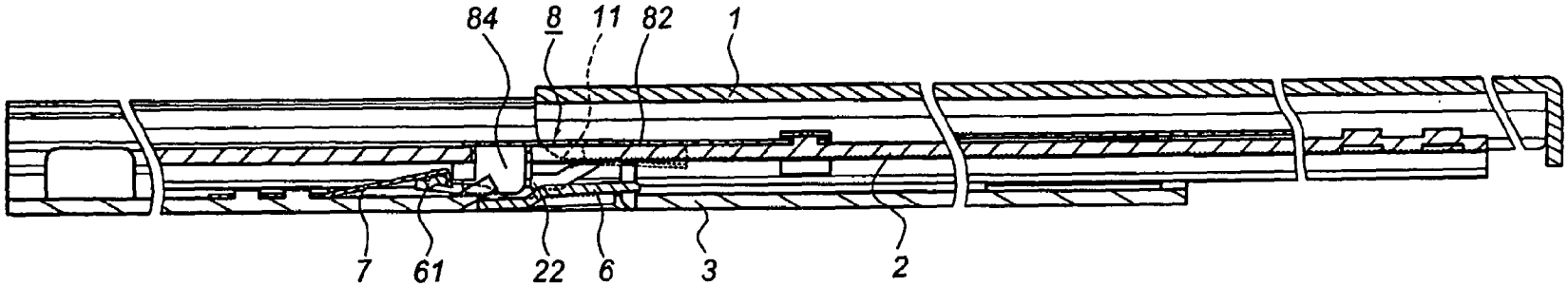
FIG. 6 is a sectional view similar to FIG. 5, wherein a locking member of the slide assembly is actuated.
Figure 7:
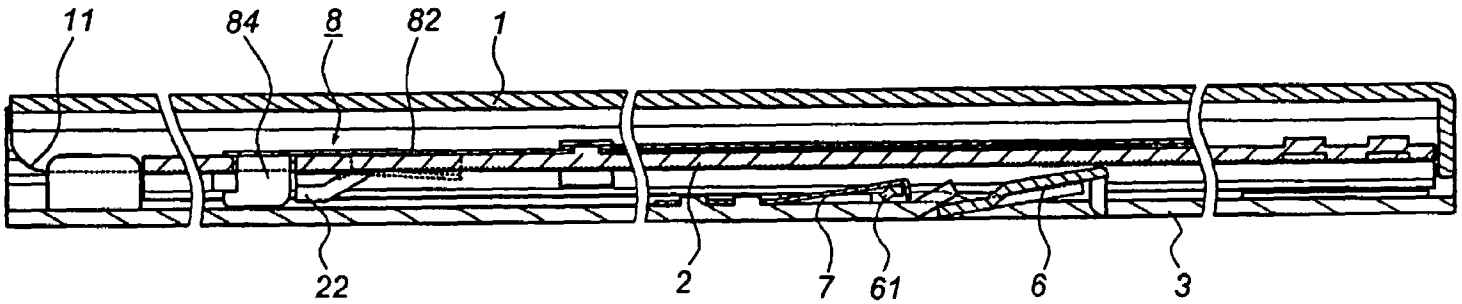
FIG. 7 is a sectional view similar to FIG. 6, wherein the inner slide member and an intermediate slide member are fully retracted.

When the inner slide member 1 is retracted into the intermediate slide member 2, two sidewalls 11 of the inner slide member 1 respectively come in contact with the slanted lateral sides 821 of the arcuate plate 82 (see FIG. 4). Further inward movement of the inner slide member 1 causes the sidewalls 11 of the inner slide member 1 to respectively press against the slanted lateral sides 821 (see FIG. 5), causing the U-shaped actuating section 84 to urge the locking member 6 away from the intermediate slide member 2 (see FIG. 6), thereby disengaging the locking member 6 from the stops 22 on the intermediate slide member 2. Thus, the intermediate slide member 2 as well as the inner slide member 1 can be further retracted into the outer track member 3 to its fully retracted position, as shown in FIG. 7.

Figure 8:
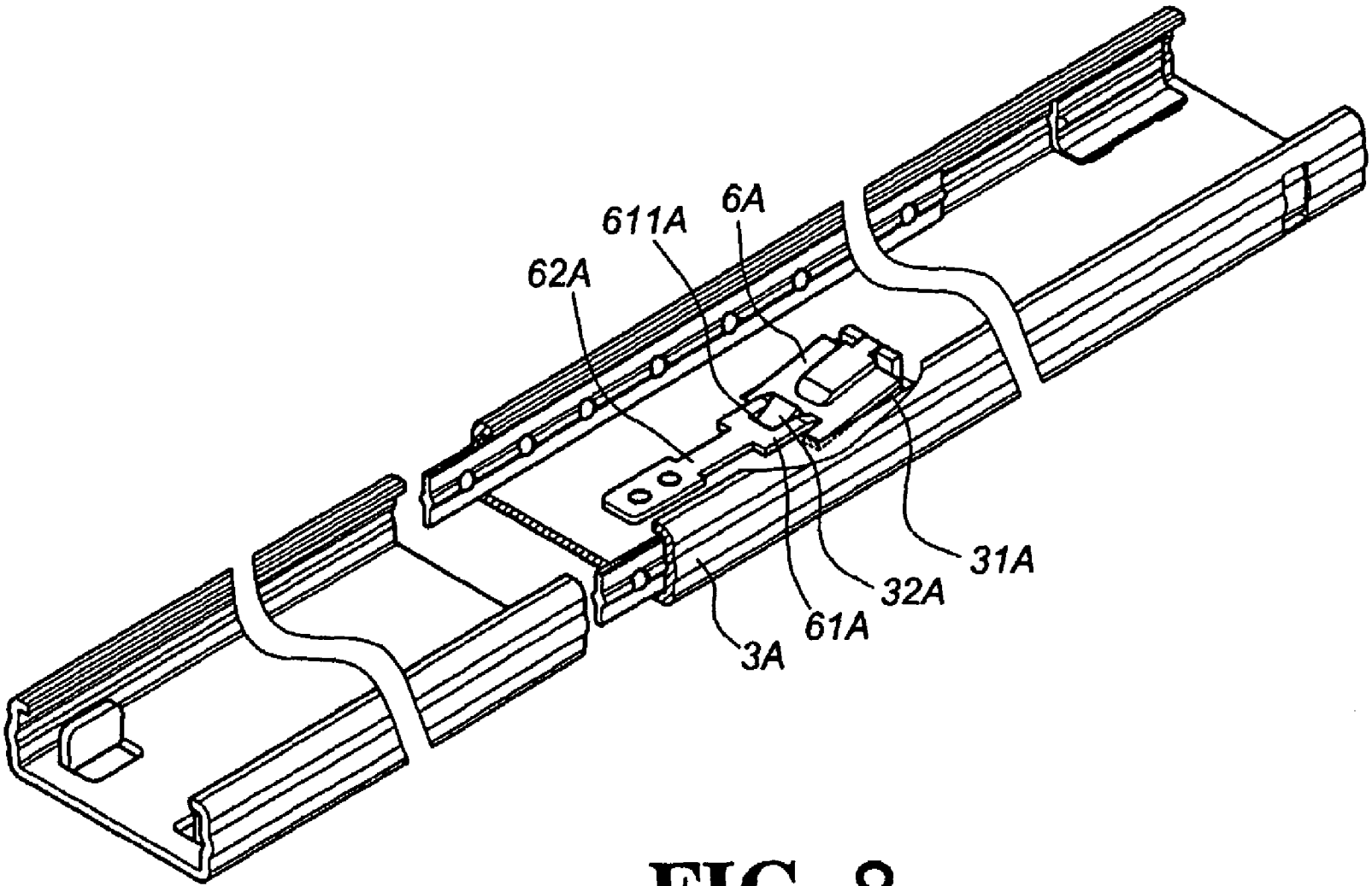
FIG. 8 is a perspective view of a modified embodiment of the slide assembly in accordance with the present invention.

FIG. 8 illustrates a modified embodiment of the invention, wherein the locking member 6A mounted on the outer slide member 3A includes an integrally formed lug 61A on an intermediate portion thereof. The lug 61A includes a hole 611A for engaging with a protrusion 32A projecting from a side of a periphery delimiting the opening 31A of the outer slide member 3A. Further, a resilient plate 62A includes a first end integrally formed with and extending from the lug 61A, with a second end of the resilient plate 62A fixed on the outer slide member 3A. Thus, the locking member 6A may sway and return to the original position as the first embodiment.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A slide assembly comprising:

an outer slide member including an opening for mounting a locking member having a first end and a second end, a lug being mounted on the first end of the locking member and abutting against a side of a periphery delimiting the opening, a resilient plate including a first end fixed on the outer slide member and a second end pressing against the lug of the locking member, thereby biasing the second end of the locking member away from an inner face of the outer slide member;

an intermediate slide member slidably received in the outer slide member, the intermediate slide member including a slot, an unlatching member being mounted on the intermediate slide member, the unlatching member including an arcuate plate having a first end and a second end and an arm extending from the first end of the arcuate member, with a distal end of the arm being fixed on the intermediate slide member, the unlatching member further including a substantially U-shaped actuating section extending from the second end of the arcuate plate, the actuating section being extendable through the slot of the intermediate slide member, with two downwardly extending stops being formed on two lateral sides delimiting the slot by pressing; and an inner slide member slidably received in the intermediate slide member.

2. The slide assembly as claimed in claim 1 wherein the lug includes a hole, and wherein the outer track includes a protrusion projecting from a side of a periphery delimiting the opening into the hole of the lug.

3. The slide assembly as claimed in claim 1 wherein the outer slide member further includes two lugs formed on a side of the periphery delimiting the opening, a space being defined between the lugs, the locking member including a projection received in the space.

4. The slide assembly as claimed in claim 1 wherein the resilient plate is integrally formed with and extends from the lug.

* * * * *